US005176351A

United States Patent [19]

Moore

[11] Patent Number: 5,176,351

[45] Date of Patent: Jan. 5, 1993

[54] ADJUSTABLE KEYBOARD SUPPORT

[75] Inventor: Edward Moore, L'Acadie, Canada

[73] Assignee: 2749394 Canada Inc., Montreal, Canada

[21] Appl. No.: 659,665

[22] Filed: Feb. 25, 1991

[51] Int. Cl.[5] ..... A47B 57/00

[52] U.S. Cl. ..... 248/286; 248/447; 108/138

[58] Field of Search ..... 248/286, 293, 298, 296, 248/447, 918-923; 108/138, 143; 312/208, 231, 233, 270.1, 270.2, 317.3, 322

[56] References Cited

U.S. PATENT DOCUMENTS

| | | | |
|---|---|---|---|
| 2,599,416 | 6/1952 | Saecker | 248/447 |
| 4,460,145 | 7/1984 | Ando | 248/447 |
| 4,625,657 | 12/1986 | Little et al. | 108/138 X |
| 4,644,875 | 2/1987 | Watt | 108/138 X |
| 4,776,284 | 10/1988 | McIntosh | 108/138 |
| 4,843,978 | 7/1989 | Schmidt et al. | 108/138 |
| 4,938,441 | 7/1990 | Hannah et al. | 108/143 X |
| 4,986,616 | 1/1991 | Chang et al. | 108/138 X |
| 4,988,066 | 1/1991 | Cotterill | 248/923 X |
| 5,031,867 | 7/1991 | Cotterill | 248/918 X |
| 5,037,054 | 8/1991 | McConnell | 248/286 X |
| 5,041,770 | 8/1991 | Seiler et al. | 248/919 X |

*Primary Examiner*—Karen J. Chotkowski
*Attorney, Agent, or Firm*—McFadden, Fincham, Marcus & Anissimoff

[57] ABSTRACT

An adjustable keyboard support, for holding keyboards for computer terminals, drawing boards, digitalizing pads and similar items, comprising a support frame which is pivotally mounted below the top surface of a terminal support stand. The support frame has spaced extendable and retractable side members, each side member having a rear member and front member. Each front member is slidably mounted on a rear member. Each rear member is pivotally attached at its rear end to the terminal support stand. A lever extends between a forward part of the terminal support stand and an intermediate position on a forward member, for each side member. Extension of the support frame swings the levers around and forward, the front members first moving down further extension causing the front member to move up as continued swinging of the levers occurs. In a further embodiment, the support provides a moveable keyboard carriage. The carriage may be vertically elevated and angularly inclined with respect to the support frames; suitably positioned levers facilitate the motion.

19 Claims, 6 Drawing Sheets

ADJUSTABLE KEYBOARD SUPPORT

FIELD OF THE INVENTION

This invention relates to an adjustable keyboard support, for holding a keyboard relative to some work surface or work member particularly for keyboards of computer terminals, such as word processors and other terminals, drawings and digitizing pads. In particular the invention relates to a keyboard support which can be extended and retracted and can also be varied in height in an extended position.

BACKGROUND OF THE INVENTION

Keyboard supports are well known, as are extendable and retractable supports. However, the actual height of the keyboard, when the support is extended, is determined by the geometry of the support and is not variable.

With the use of computers and similar hardware now commonplace, various user ailments have developed. These ailments include back pain from poor posture while at the terminal, neck pain, wrist difficulties, etc.

A more common ailment experienced by computer users is repetitive strain injury which is a group of disorders affecting muscles, tendons and nerves. This occurs from activities involving awkward posture and repetitive movement of the same muscles frequently without allowing the muscles any rest periods.

Currently, repetitive strain injuries are recognized as a leading cause of productivity losses and as an economic burden on society.

The present invention circumvents the discomfort experienced by computer users by providing a keyboard support which permits the keyboard to be adjustable in height. This enables a user to adjust the attitude of the keyboard for ease and comfort of operation to a more orthopaedically favourable position.

SUMMARY OF THE INVENTION

In accordance with one object of the present invention, there is provided a keyboard support which includes a keyboard carriage which provides elevation adjustment as well as tilt. In such an arrangement much of the muscle stress experienced by computer users can be alleviated since each user can adjust the keyboard to a suitable non-strenuous attitude.

Another object of the present invention is to provide an adjustable keyboard support comprising a support frame having two extendable and retractable side members; each side member including a rear member and a front member extendable and retractable relative to the rear member; means for pivotally attaching each rear member at its rear end to a terminal support stand; a lever pivotally attached at its lower end to each front member at an intermediate position and including means for pivotally attaching each lever at its upper end to the terminal support stand, the arrangement being such that initial extension of the support frame moves each front member forward and down to a lowest position, continued extension moving the front member forward and upward.

Generally, the support comprises tubular metal sufficiently strong to impart adequate support without excessive weight. Such metal may be aluminium, stainless steel, etc. Suitable plastic material may be used as well e.g. ABS, PVC, etc.

Further the metal support may be electroplated with chromium for example, or electrochemically treated with other materials for appearance purposes.

The extension and retraction of the support is achieved by telescopic motion which may be effected by, for example, incorporating piston and cylinder arrangements known in the art.

A further object of the present invention is to provide an adjustable keyboard support with which the user may operate the keyboard in an orthopaedically favourable position.

The support may optionally include a wrist rest comprising a padded cylinder extending between the support adjacent the keyboard.

In one embodiment of the present invention initial extension of the keyboard support pivots the levers down and forward at their ends attached to front member, to a generally vertical position on the levers. Further extension pivots the levers forward and up at their ends attached to the front members, causing the forward end of the support member, and the keyboard, to move up. The further extension can be varied at will, to give a variable height of the keyboard. Means may be provided to locking the support member in any desired extension.

A still further object of the present invention is to provide an adjustable keyboard support comprising a support frame having two extendable and retractable side members; each side member including a rear member and a front member extendable and retractable relative to the rear member; means for pivotally attaching each rear member at its rear end to a terminal support stand; a first lever pivotally attached at its lower end to each front member at an intermediate position and including means for pivotally attaching each first lever at its upper end to the terminal support stand, a keyboard carriage member adapted to receive a keyboard movably mounted to each front member, a second lever pivotally connected at its lower end to each front member and spaced forwardly of the first lever, each second lever being pivotally connected to the keyboard carriage whereby initial extension of the support frame moves each front member forward thereby facilitating the keyboard carriage to be moved vertically and angularly inclined to the support member.

Yet another object of the present invention is to provide an adjustable keyboard support comprising a support frame having two side members, each side member including a forward end, a rear end and an intermediate portion, first lever means pivotally attached at lower ends thereof to each rear end of the side members; second lever means pivotally attached at lower ends thereof to each intermediate portion of the side members, the first and second lever means including means for pivotally attaching the first and second lever means at upper ends thereof to the terminal support stand; and means for pivotally interconnecting each of the first and second lever means of each of the side members, the arrangement being such that the support frame is swingably moveable from a lowest position to a position forward and upward therefrom.

By employing lever linkages in the embodiments of the present invention, multiple dimensional adjustment may be achieved.

In an alternate form, the keyboard carriage may be modified to provide a single point keyboard attachment which splits to mount at both levers.

In a further alternate from, the retractable and extendable mounting may be replaced by a single retractable and extendable member suitably large to provide adequate support for a keyboard and any downward pressure exerted by a user.

The invention will be readily understood by the following description of certain embodiments, by way of example, in conjunction with the accompanying drawings.

DETAILED DESCRIPTION OF THE PREFERRED EMBODIMENTS

Figure 1:
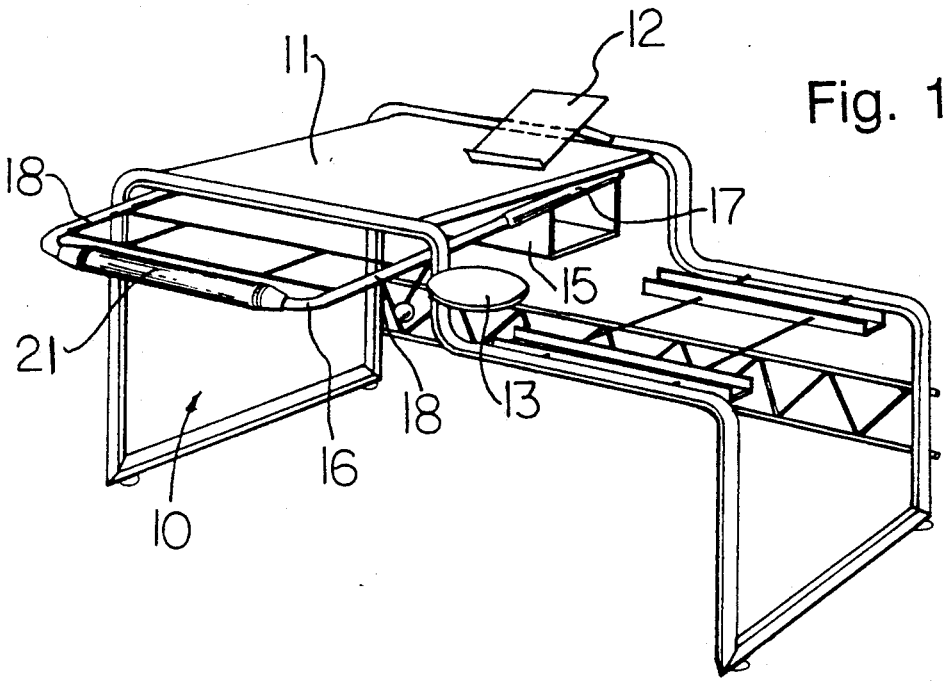
FIG. 1 is perspective view of a terminal stand with a keyboard support member as in the invention.

As illustrated in FIG. 1, a terminal stand 10 has a support surface 11, a copy holder, if desired, 12, a further support surface 13, and a keyboard support member 14.

Figure 2:
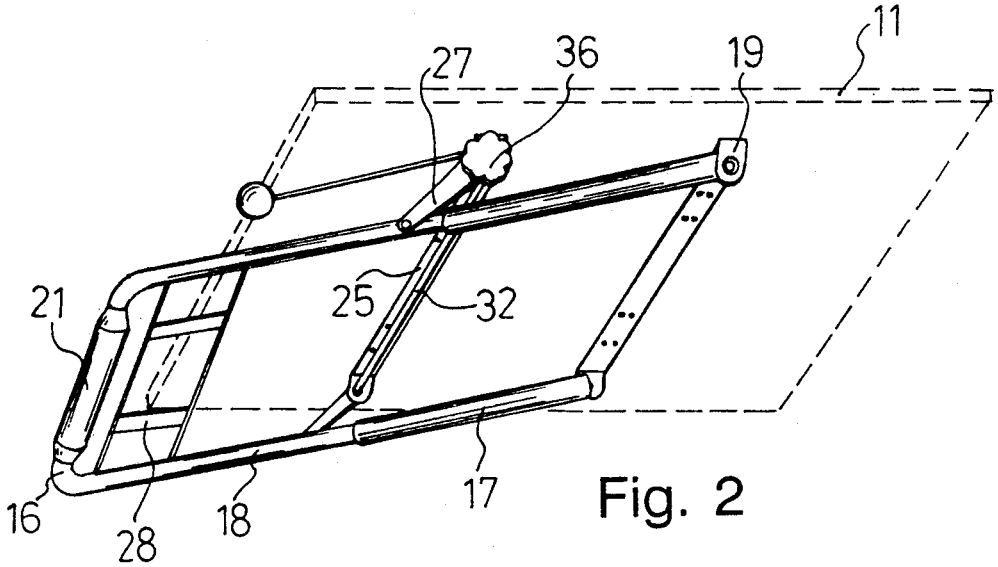
FIG. 2 is a perspective view from below of the keyboard support member.

As seen in FIG. 1, and also in FIG. 2, the keyboard support member 14 has two extendable and retractable side members 15 joined at their front end by a transverse member 16. Each side member has a rear member 17 and a front member 18. In the example the front and rear members are tubular and the front member slides in the rear member. At the rear end of each rear member 17 is a bracket 19 attached to the terminal stand 10, the rear end of the rear member pivotally attached to the bracket. The brackets 19 can be of individual brackets, one at each side, or unitary brackets extending across between the rear ends of the rear members 17. Conveniently the front members 18 are formed from a single length of material, formed to a U-shape to give the two front members 18 and the front transverse member 16. For comfort the transverse member 16 is covered with a padded material 21.

Attached to the underside of the support surface of the terminal stand, towards the front part, is a pivotal support member 25. This will be seen in more detail in FIGS. 3 and 4. At an intermediate position 26 on each front member 17 is pivotally attached the lower end of a lever 27. The levers 27 are pivotally attached at their upper ends to the pivotal support member 25. The position 26 on each front member is, in the example, just forward of the front end of each rear member 17, when the front members are retracted. This will be readily seen from FIGS. 3 and 4, and FIG. 5, and appreciated from the accompanying description. Also seen in FIG. 2 are two keyboard supports and holders 28.

Figure 3:
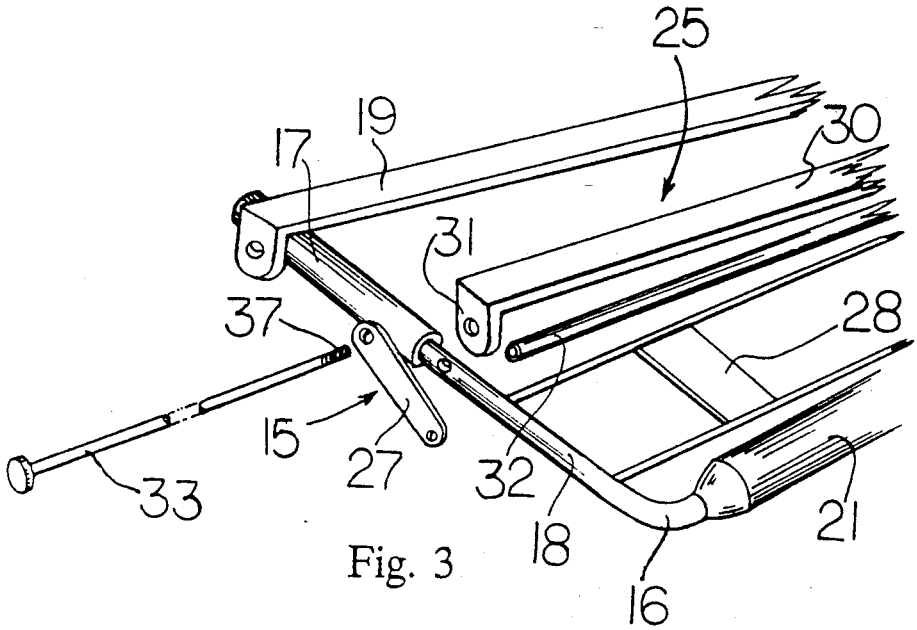
FIG. 3 is an enlarged exploded view of one side member of the keyboard support member.
Figure 4:
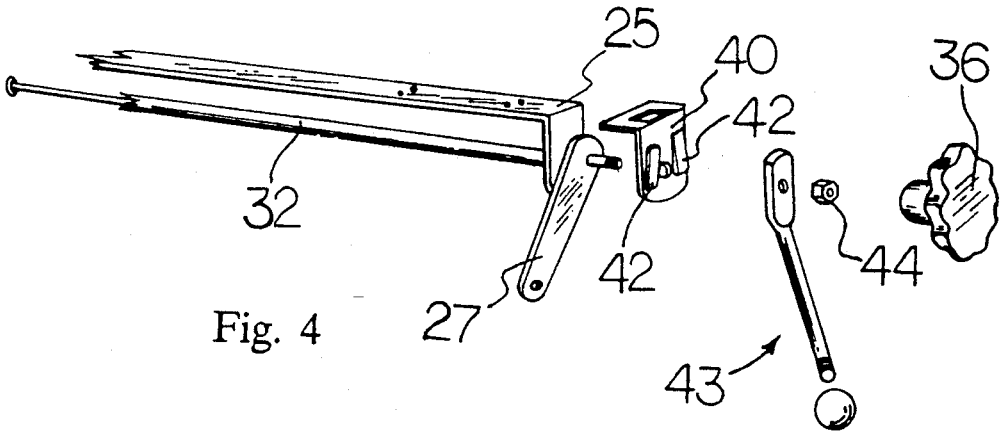
FIG. 4 is an enlarged exploded view of the other side, relative to FIG. 3, illustrating the pivotal support member and a locking arrangement.
Figure 5A:
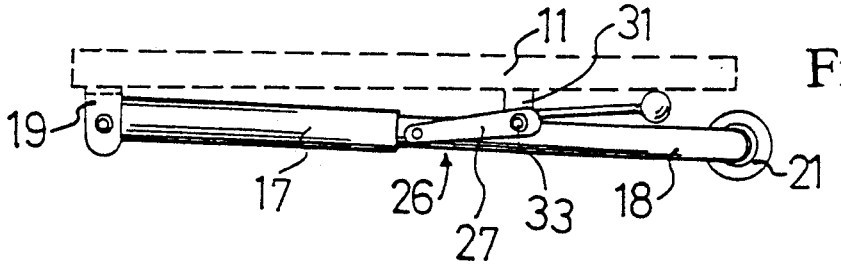
FIGS. 5A to 5D illustrate the various stages of extension of the keyboard support.
Figure 5B:
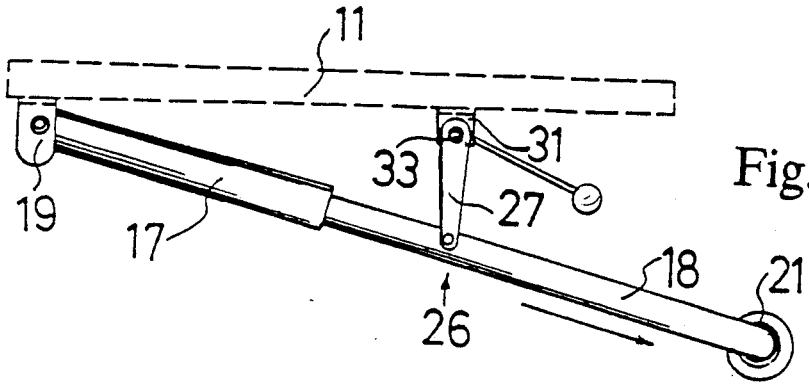
Figure 5C:
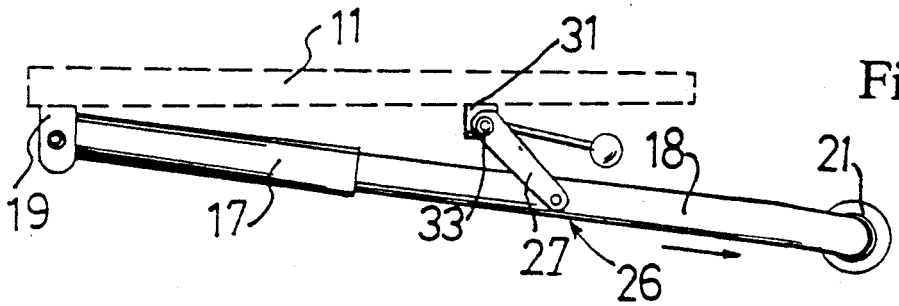
Figure 5D:
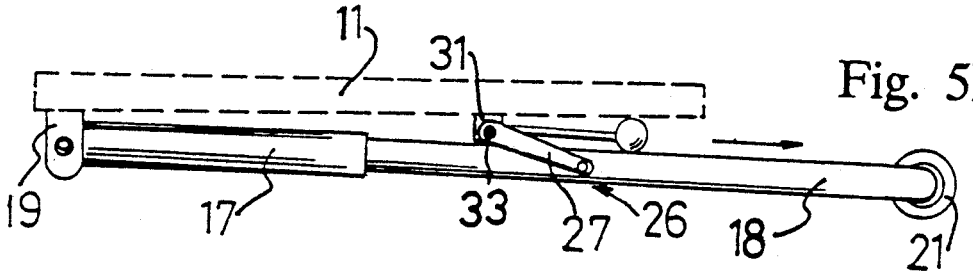

As more readily seen in FIGS. 3 and 4, the pivotal support member 25, in the example, comprises a transverse member 30 having a web 31 extending normal to the member 30, at each end, one end being seen in FIG. 3, and the other end seen in FIG. 4. A tube 32 extends between the webs 31. The levers 27 are attached to the pivotal support member by a long headed bolt 33 which extends through a hole 34 in each lever 27, at one end, through holes 35 in the webs 31 and through the tube 32. A knob 36 (FIG. 2) screws onto the threaded end 37 of the bolt 33. The bolt 31 can be inserted from either side, with the knob 36 being at either side, as desired. Levers 27 are pivotally attached at their other ends to the front members 18, at positions 26.

The knob 36 can serve to tighten the levers 27 and lock the various components against movement. Alternatively a locking mechanism can be provided.

FIG. 4 illustrates one form of locking mechanism which can be provided for locking the keyboard support member 14 (FIG. 1) in a desired position. In the example illustrated, a cam member 40 fits over the bolt 33, outside of the lever 27 and is held from rotation by legs 41 which extend over the pivotal support member 25. On the outer surface of the cam member are formed two inclined camming surfaces 42. The camming surfaces 42 are inclined in opposite directions. Outside of the cam member 40 is a locking lever 42 freely rotatable on the bolt 33. Then there is positioned a nut 44. The nut is tightened up on the threaded portion of the bolt 33 to hold the assembly of levers 27, pivotal support member 25, rod 33, tube 32, cam member 40 and locking lever 43 in a firm but movable condition. After tightening the nut 44 to the desired position, the knob 36 frictionally engages nut 44 and may be used to adjust the force of locking lever 43 against cam member 40.

Once the keyboard support member has been moved to the desired position, rotation of the locking lever 43 will tighten bolt 33 by the action of the locking lever riding up the camming surfaces 42. This will tighten the whole assembly and lock the keyboard support member in position.

While, in FIGS. 2, 3 and 4, the locking mechanism comprising bolt 33, tube 32 with either the knob 36 alone, or with the locking lever 43 and cam member 40, is shown as extending through the upper ends of the levers 27 and the webs 31, it is possible to position the bolt 33 and tube 32 extending between the lower ends of the levers 27. The upper ends of the levers 27 would then be pivotally attached to the webs 31 by any suitable pivot means, such as rivets, bolts and nuts, or other means.

The action of extending the keyboard support is illustrated at various stages in FIG. 5. In FIG. 5(*a*) the support is in a fully retracted position, with levers 27 extending slightly down but mostly rearwards, from the pivotal support member 25. As the keyboard support is extended forward, the front members 18 slide out of the rear members 17, with the levers 27 swinging down and around, the side members 15 pivoting down about the pivots at brackets 19. FIG. 5(*b*) shows the extended position with the lowest position of the front ends of the side members and thus the lowest keyboard height of the keyboard, levers 17 being generally vertical.

In FIG. 5(*c*) the keyboard support has been further extended, with levers 17 swinging forward and up. This raises the keyboard, this Figure showing an intermediate position. In FIG. 5(*d*) the keyboard support is fully extended with the levers 27 swinging up almost horizontal. This has further raised the keyboard to the highest position.

The difference in height of the forward end of the front members 18, which carry the keyboard holders 28, from that shown in FIG. 5(*b*) to that shown in FIG. 5(*d*) is the height variation available. There is also some small forward movement of the keyboard holders.

The amount of height variation, and the amount of extension and retraction, will vary depending upon the length of the lever 27. Longer levers will give more height variation with some added extension.

Various modifications can be made. For example the side members 15 need not have tubular rear members 17 with front members 18 sliding into the tubular members. Other forms of extendable and retractable structures can be used. Instead of a single transverse pivotal support member 25, a bracket can be provided at each side of the support surface 11 and the levers 27 pivotally attached to the brackets. With such a structure, two knobs 36 would normally be provided, one at each side and these can be used to lock the pivot joints or two cam locking members as in FIG. 4 can be used. Various other members can be varied in structure without departing from the basic concept of the invention.

Figure 6:
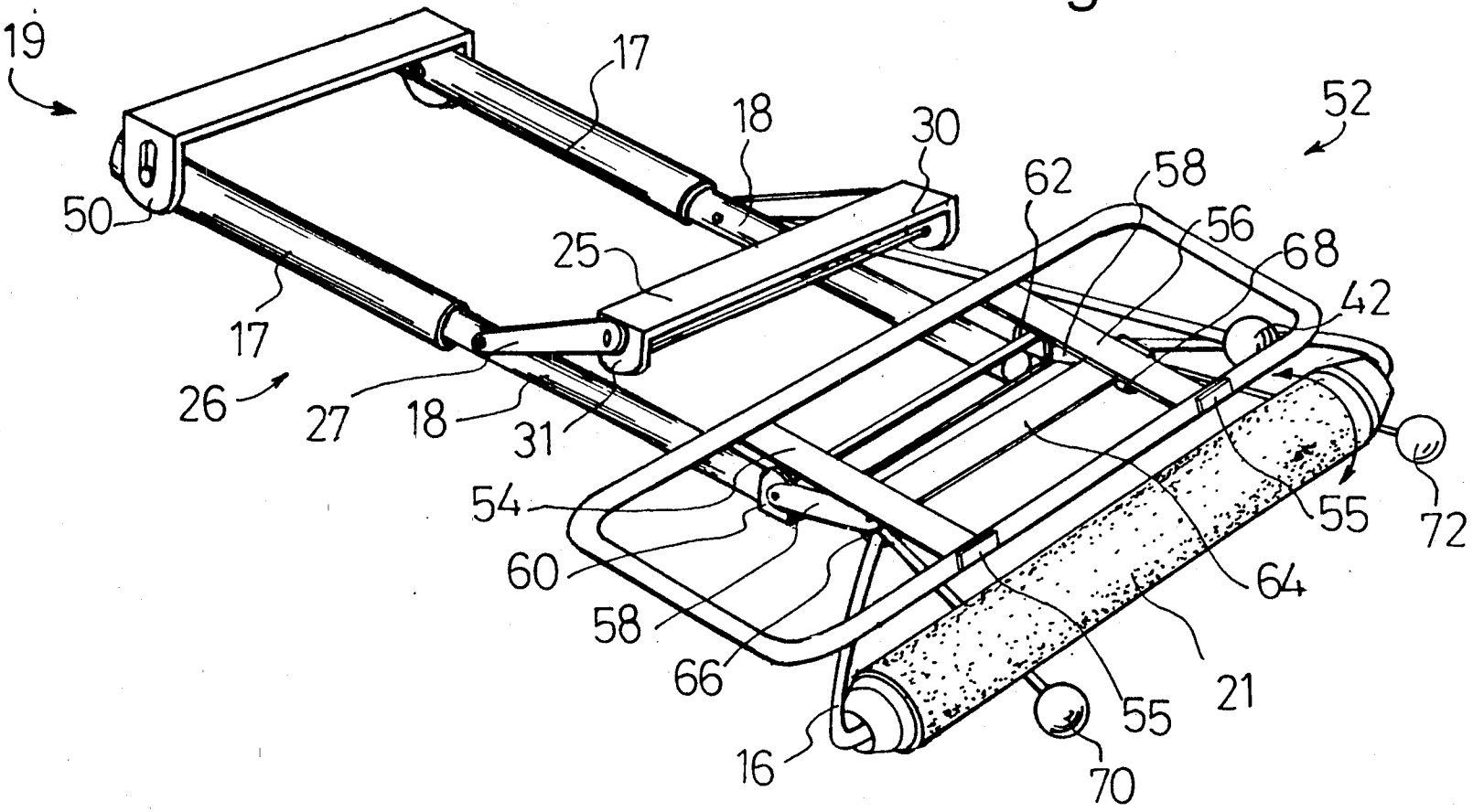
FIG. 6 is a perspective view of a second embodiment of the keyboard support member.

Referring to FIG. 6, shown is another embodiment of the present invention. Similar numerals from the previous embodiment indicate common components. In this embodiment the brackets 19 are slidably mounted to each rear member 17 for vertical adjustment. A knob 50 can function to tighten the brackets 19 against movement on members 17.

Movably mounted proximate the forward ends of the retractable side members 15 is a keyboard carriage 52. The carriage is formed from a single length of material to a generally rectangular frame and includes spaced apart cross-members 54 and 56 mounted to the frame and including upwardly projecting legs 55 for supporting and retaining a keyboard (not shown). Spaced forwardly on the first levers 27 are second levers 58 pivotally connected at the lower ends thereof to webs 60 and 62 which, in turn, each are secured to front member 18. Extending between cross-members 54 and 56 is a transverse member 64 which includes at each end thereof, downwardly extending webs 66, 68 which pivotally connect the upper ends of second levers 58. In such an arrangement, the keyboard carriage 52 may be vertically elevated to a spaced apart parallel plane with respect to the front and rear members 17 and 18, the extent of elevation being dependent upon the length of second lever 58. The elevation may be fixed by engaging a knob or lever 70 associated with web 60 or 62 of the lower end of second lever 58 employing similar engagement to that illustrated in FIG. 4. In addition, the arrangement facilitates pivotal motion of the keyboard carriage 52 from a parallel position with the front and rear members 17 and 18 to a position where the carriage 52 is angularly inclined thereto. Similarly, a further knob or lever 72 associated with upper ends of second levers 58 and webs 66 or 68. Further, in this embodiment, the padded material may be freely rotatable on the transverse member.

It will be appreciated that a diverse variety of keyboard positions can be achieved by manipulation of levers 70 and 72 singly or in combination.

FIG. 7 illustrates in various stages, the keyboard carriage 52 in use.

Figure 7A:
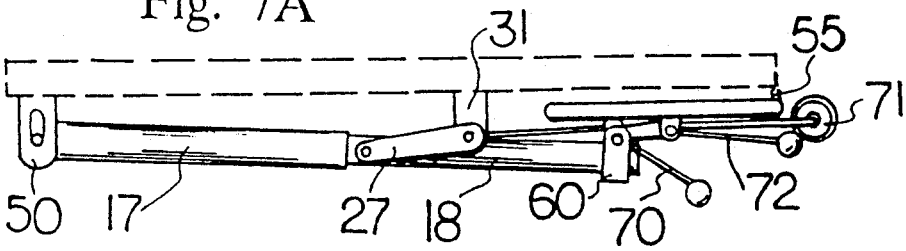
FIGS. 7A to 7D illustrate various positions for the keyboard carriage.

FIG. 7(A) shows the carriage 52 in a fully collapsed position, i.e. parallel to members 17 and 18.

Figure 7B:
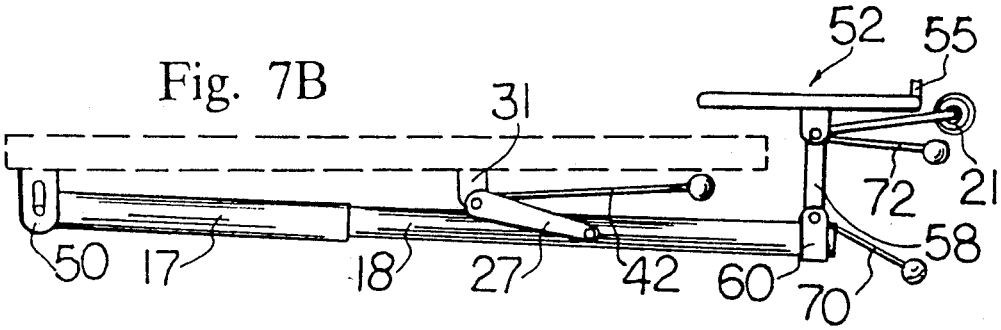

FIG. 7(B) illustrates the carriage 52 in a slightly elevated position in which the same is in a vertically spaced parallel plane with respect to the plane of the members 17 and 18.

Figure 7C:
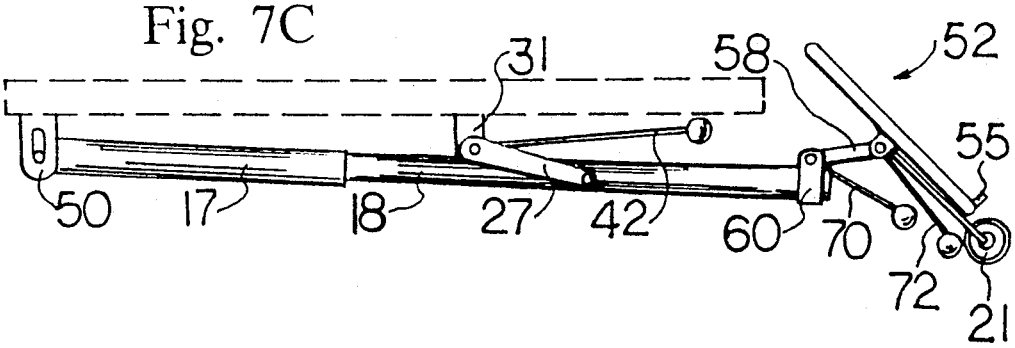

FIG. 7(C) shows the keyboard carriage 52 in an angularly inclined position, i.e. pivoted about webs 66 and 68.

Figure 7D:
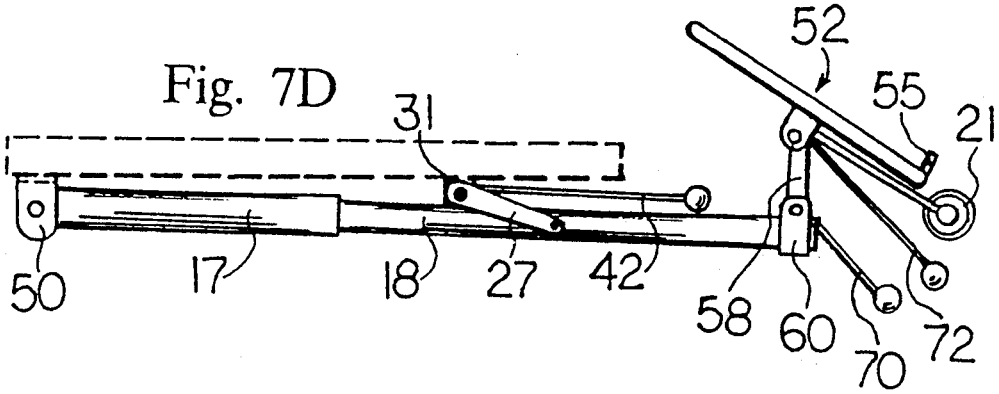

FIG. 7(D) shows the carriage 52 in a vertically elevated position as illustrated in FIG. 7(B) and additionally angularly inclined as illustrated in FIG. 7(C).

It will be understood that the locking levers 70 and/or 72 may be used to retain the carriage 52 in any desired position.

Figure 8:
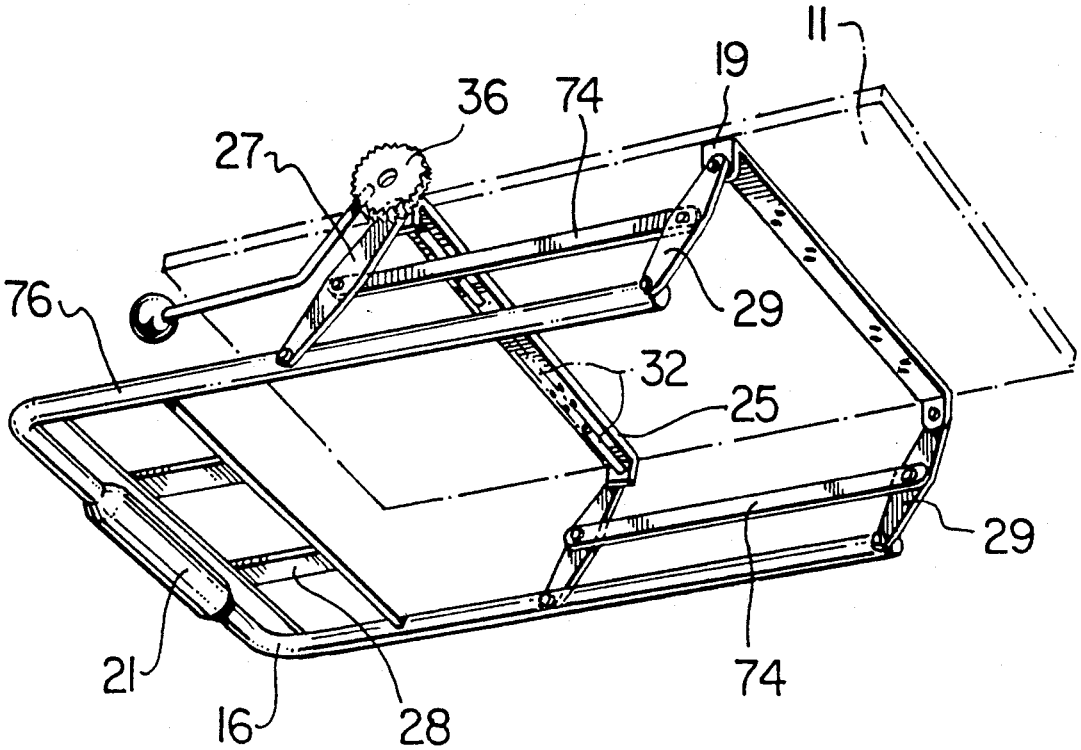
FIG. 8 is a perspective view from below of yet another embodiment of the present invention.

Referring now to FIG. 8, shown is yet another embodiment of the present invention. Similar components from previous embodiments are indicated by the same numerals. In this embodiment, the front and rear members 17 and 18, illustrated in the previous Figures, are eliminated and simply replaced by the single length of material formed to a U-shape (herein previously described) to provide two side members 76 and a front transverse member 16. In addition, levers 19 are included and pivotally attached at their upper ends to bracket 19 and at their lower ends to each of side members 76. A crossmember 74 extends between levers 27 and 29 and is pivotally connected intermediate of the upper and lower ends of the levers. In this arrangement, the crossmembers are parallel to each side member 76 in a vertical and upwardly spaced apart plane with respect to each side member 76.

In operation, the keyboard support member 14 may be swung into a desired position and releasably locked with knobs 36. The keyboard carriage 52 having vertical and attitude adjustment shown in FIGS. 6 and 7 may be easily added to this embodiment as will be understood by those skilled in the art.

As those skilled in the art would realize these preferred illustrated details can be subjected to substantial variation, without affecting the function of the illustrated embodiments.

Although embodiments of the invention have been described above, it is not limited thereto and it will be apparent to those skilled in the art that numerous modifications form part of the present invention insofar as they do not depart from the spirit, nature and scope of the claimed and described invention.

I claim:

1. An adjustable keyboard support comprising a support frame having two extendable and retractable side members; each side member including a rear member and a front member in axial alignment, the front member axially extendable and retractable relative to the rear member; means for pivotally attaching each rear member at its rear end to a terminal support stand; a first lever pivotally attached at its lower end to each said front member at a position intermediate the ends of said front member and including means for pivotally attached each first lever at its upper end to said terminal support stand, the arrangement being such that initial extension of the support frame moves each front member forward and down to a lowest position, continued extension moving the front member forward and upward.

2. A keyboard support as claimed in claim 1 including a transverse front member extending between front ends of said front members.

3. A keyboard support as claimed in claim 2, said transverse front member including a soft padded covering.

4. A keyboard support as claimed in claim 1, said means for pivotally attached each rear member at its rear end comprising a bracket for attachment to said terminal support stand.

5. A keyboard support as claimed in claim 1, said means for pivotally attaching each said lever at its upper end to said terminal support stand comprising a transverse pivotal support member for attachment beneath a top surface of said terminal support stand, said pivotal support member including a downwardly extending web at each end, each said lever pivotally attached at its upper end to one of said webs.

6. A keyboard support as claimed in claim 5, including a tube extending between said downwardly extending webs and an elongate bolt traversing from one side to the other and passing through in sequence the upper end of a first one of said levers, through a first one of said webs, through said tube, through the second one of said webs, and through the upper end of the second one of said levers, and including means for retaining said bolt in position.

7. A keyboard support as claimed in claim 7, said means for retaining said bolt in position comprising a head at one end, a threaded portion at its other end, and a knob screwed onto said threaded portion.

8. A keyboard support as claimed in claim 7, including locking means at at least one side of said support frame.

9. A keyboard support as claimed in claim 8, said locking means comprising a cam member non-rotatably mounted on said transverse pivotal support member, said elongate bolt rotatable in said cam member, said cam member positioned external to said second one of said levers camming means on an external surface of said cam member, a locking lever pivotally mounted on said elongate bolt external of said cam member, said locking lever held on said bolt by said knob, whereby pivoting of said locking lever engages said locking lever with the camming means to tighten said levers on said webs and said tube to lock said keyboard support in a desired position.

10. A keyboard support as claimed in claim 9, including a nut on said threaded portion of said bolt, external of said locking lever, said knob engaged with said nut and holding said nut non-rotative relative to said locking member.

11. A keyboard support as claimed in claim 1 including a keyboard holder extending inwardly from each said front member.

12. A keyboard support as claimed in claim 5, said keyboard holder extending between said front member.

13. A keyboard support as claimed in claim 1, a keyboard carriage member adapted to receive a keyboard movably mounted to each said front member, a second lever pivotally connected at its lower end to each said front member and spaced forwardly of said first lever, each second lever being pivotally connected to said keyboard carriage whereby initial extension of said support frame moves each front member forward thereby facilitating said keyboard carriage to be moved vertically and angularly inclined to said support member.

14. A keyboard support as claimed in claim 13 including a transverse front member extending between front ends of said front members.

15. A keyboard support as claimed in claim 14, said transverse front member including a freely rotatable soft padded covering.

16. A keyboard support as claimed in claim 13, said end comprising a bracket for attachment to said terminal support stand.

17. A keyboard support as claimed in claim 13, said means for pivotally attaching each said lever at its upper end to said terminal support stand comprising a transverse pivotal support member for attachment beneath a top surface of said terminal support stand, said pivotal support member including a downwardly extending web at each end, each said lever pivotally attached at its upper end to one of said webs.

18. A keyboard support as claimed in claim 13, wherein said keyboard carriage includes cross-members for supporting a keyboard.

19. A keyboard support as claimed in claim 13, including locking means at at least one of said second levers.

* * * * *